US009133813B2

(12) United States Patent
Kraus et al.

(10) Patent No.: US 9,133,813 B2
(45) Date of Patent: Sep. 15, 2015

(54) FLOW-PROTECTION DEVICE ON A LASER SPARK PLUG FOR IMPROVING THE IGNITION BEHAVIOR

(75) Inventors: Markus Kraus, Wiesng (AT); Martin Weinrotter, Stutgart-Botnang (DE); Pascal Woerner, Stuttgart (DE); Friedrich Gruber, Hippach (AT)

(73) Assignee: ROBERT BOSCH GMBH, Stuttgart (DE)

( * ) Notice: Subject to any disclaimer, the term of this patent is extended or adjusted under 35 U.S.C. 154(b) by 1277 days.

(21) Appl. No.: 13/054,417

(22) PCT Filed: Jul. 14, 2009

(86) PCT No.: PCT/EP2009/059002

§ 371 (c)(1),
(2), (4) Date: Apr. 4, 2011

(87) PCT Pub. No.: WO2010/007066

PCT Pub. Date: Jan. 21, 2010

(65) Prior Publication Data

US 2011/0185996 A1 Aug. 4, 2011

(30) Foreign Application Priority Data

Jul. 15, 2008 (DE) ..... 10 2008 040 429

(51) Int. Cl.

| | |
|---|---|
| ***F02B 19/00*** | (2006.01) |
| ***F02P 23/04*** | (2006.01) |
| ***F02P 13/00*** | (2006.01) |
| ***F02P 15/08*** | (2006.01) |
| ***F23Q 13/00*** | (2006.01) |

(52) U.S. Cl.

CPC ..... *F02P 23/04* (2013.01); *F02P 13/00* (2013.01); *F02P 15/08* (2013.01); *F23Q 13/00* (2013.01)

(58) Field of Classification Search

CPC ..... F02P 23/04; F02C 7/22; F02C 9/26; F23R 3/286; F23R 3/28

USPC ..... 123/143 B, 143 R, DIG. 9, 143 C; 431/254; 372/71, 72, 108, 109, 701; 60/39.821, 776

See application file for complete search history.

(56) References Cited

U.S. PATENT DOCUMENTS

| | | | |
|---|---|---|---|
| 1,392,364 | A | 10/1921 | Smith |
| 3,926,169 | A | 12/1975 | Leshner et al. |
| 4,219,001 | A | 8/1980 | Abe et al. |

(Continued)

FOREIGN PATENT DOCUMENTS

| | | |
|---|---|---|
| DE | 74 86 41 | 11/1944 |
| DE | 39 13 665 | 10/1990 |

(Continued)

*Primary Examiner* — Thomas Moulis
*Assistant Examiner* — Joseph Dallo
(74) *Attorney, Agent, or Firm* — Kenyon & Kenyon LLP

(57) ABSTRACT

A laser spark plug, in particular for an internal combustion engine, having an arrangement or structure for coupling, especially focusing, laser radiation in or on an ignition point, including an arrangement or structure for influencing a fluid flow disposed in an end region of the laser spark plug on the side of the combustion chamber, which constitute an essentially sleeve-shaped extension of the laser spark plug in the direction of the combustion chamber, in which the arrangement or structure for influencing the fluid flow is configured to influence the fluid flow in the region of the ignition point.

14 Claims, 5 Drawing Sheets

(56) References Cited

U.S. PATENT DOCUMENTS

| | | | | |
|---|---|---|---|---|
| 6,304,023 | B1 | 10/2001 | Chan | |
| 7,040,270 | B2 * | 5/2006 | Herdin et al. | 123/143 B |
| 7,040,280 | B1 | 5/2006 | Drake | |
| 7,806,094 | B2 * | 10/2010 | Gruber | 123/143 B |
| 8,312,854 | B2 * | 11/2012 | Weinrotter et al. | 123/143 B |
| 8,322,320 | B2 * | 12/2012 | Oledzki | 123/143 B |
| 2007/0064746 | A1 * | 3/2007 | Winklhofer et al. | 372/10 |
| 2007/0242714 | A1 * | 10/2007 | Sumida et al. | 372/40 |
| 2009/0159031 | A1 * | 6/2009 | Gruber | 123/143 B |

FOREIGN PATENT DOCUMENTS

| | | |
|---|---|---|
| DE | 10 2004 039818 | 3/2006 |
| DE | 10 2006 015600 | 10/2007 |
| DE | 10 2006 018973 | 10/2007 |
| EP | 0 249 241 | 12/1987 |
| EP | 1 329 631 | 7/2003 |
| EP | 2 072 803 | 6/2009 |
| FR | 2 470 462 | 5/1981 |
| FR | 2 873 763 | 2/2006 |
| WO | 92/02718 | 2/1992 |

* cited by examiner

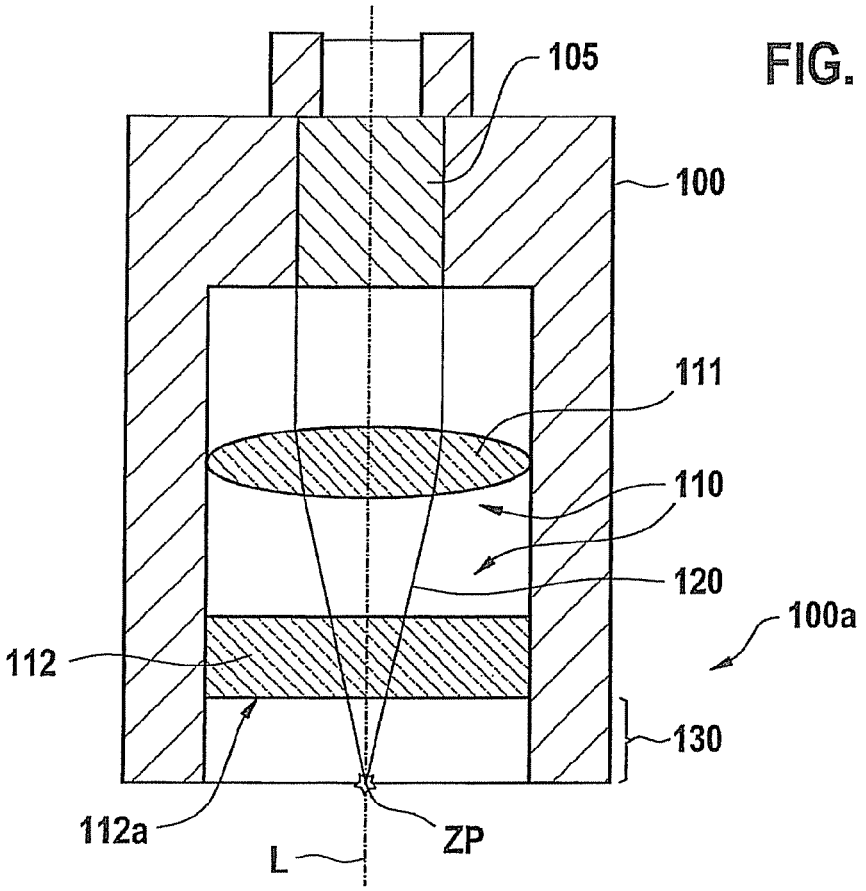
FIG. 1
FIG. 2
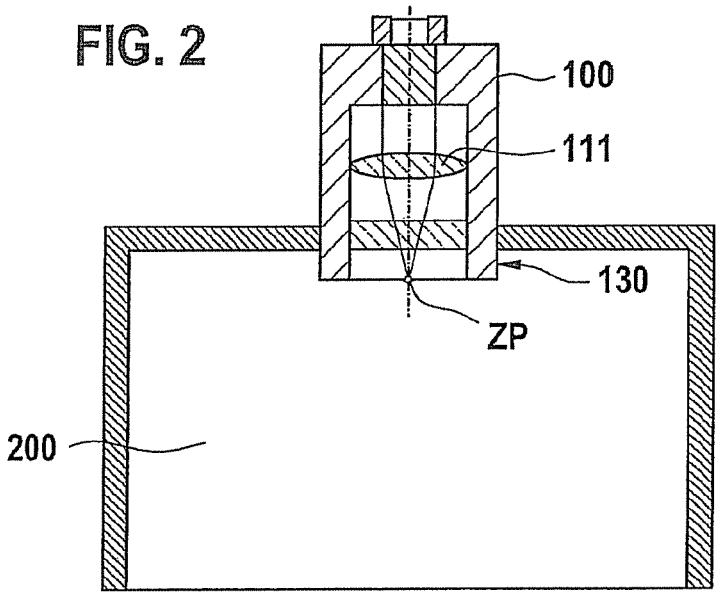

FLOW-PROTECTION DEVICE ON A LASER SPARK PLUG FOR IMPROVING THE IGNITION BEHAVIOR

FIELD OF THE INVENTION

The present invention relates to a laser spark plug, in particular for an internal combustion engine, having a arrangement or structure for coupling, particularly focusing, laser radiation in or on an ignition point, and to a method for igniting a fluid in an internal combustion engine.

BACKGROUND INFORMATION

Such laser spark plugs are believed to be used in high-efficiency internal combustion engines whose operation is characterized by a correspondingly high degree of turbulence of a gas mixture in the combustion chamber. Especially in an operation in the range of the lean limit, a high level of turbulence in the combustion chamber is aimed for in order to improve the thermodynamic efficiency.

Because of the strong turbulence in the combustion chamber, a flame core produced with the aid of a laser ignition device, whose energy does not attain a critical limit, may be extinguished again shortly after ignition, which leads to undesired combustion misses when the internal combustion engine is in operation.

SUMMARY OF THE INVENTION

Accordingly, it is an object of the exemplary embodiments and/or exemplary methods of the present invention to improve a laser spark plug of the type mentioned in the introduction such that a reliable ignition of an ignitable mixture takes place even at relatively high levels of turbulence of the ignitable mixture.

In the case of a laser spark plug of the type mentioned in the introduction, this object is achieved according to the exemplary embodiments and/or exemplary methods of the present invention in that an end area on the side of the combustion chamber of the laser spark plug is provided with a arrangement or structure for influencing a fluid flow, which constitute an essentially sleeve-type extension of the laser spark plug in the direction of the combustion chamber, and which are designed to influence a fluid flow in the region of the ignition point.

Because of the arrangement or structure according to the present invention for influencing the fluid flow in the region of the ignition point, it is advantageously possible to adjust a fluid flow that is especially advantageous for the laser ignition. The selective influencing of a flow field at the location of the laser ignition according to the present invention ensures an improved ignitability of the ignitable mixture in the ignition point, so that laser pulses having lower pulse energy may advantageously be used for a reliable ignition. In an advantageous manner the use of the laser spark plug according to the present invention therefore makes it possible to use laser systems having lower ignition pulse energies, which results in lower production costs of corresponding laser ignition systems and longer operating times.

At the same time, the principle of the exemplary embodiments and/or exemplary methods of the present invention increases the running smoothness of the internal combustion engine, which also manifests itself in greater efficiency and/or a reduction in the exhaust emissions of the internal combustion engine.

In one advantageous specific embodiment of the laser spark plug according to the present invention, a configuration which is simple in terms of production technology and mechanically very robust, is obtained as a result of the fact that the arrangement or structure for influencing the fluid flow constitute an integral part of the laser spark plug. For instance, the arrangement or structure for influencing the fluid flow according to the present invention may be implemented directly in one piece with the rest of the body of the laser spark plug or be connected to it.

One especially advantageous option for influencing the fluid flow in the region of the ignition point is provided in that the arrangement or structure for influencing the fluid flow according to the present invention have a basically hollow-cylindrical base form and are disposed concentrically with respect to a longitudinal axis of the laser spark plug.

The principle of the laser spark plug according to the present invention is based on the fact that the arrangement or structure for influencing a fluid flow allow at least partial shielding of the flow field disposed about the ignition point from additional fluid flows that surround the end region of the spark plug on the side of the combustion chamber. In this manner, in particular a flame core that occurs in the ignition point during the laser ignition is able to be protected from a usually relatively turbulent combustion chamber flow. In particular, quench flows laterally approaching the ignition point or the produced flame core are able to be weakened or deflected when using the arrangement or structure for influencing the fluid flow according to the present invention.

In another very advantageous specific development of the laser spark plug according to the present invention, a deflection of the fluid flow in the end region of the laser spark plug on the side of the combustion chamber is advantageously made possible by the fact that the arrangement or structure for influencing the fluid flow have in their end region on the side of the combustion chamber an at least sectionally beveled end face, i.e., a surface normal of the particular end face forms an angle with the longitudinal axis of the laser spark plug that differs from 0°. The deflection of the fluid flow according to the present invention makes it possible to adjust ideal conditions for the ignition in the region of the ignition point. As already explained in connection with the other specific embodiments of the present invention, this variant of the present invention also reduces the level of turbulence around the ignition point. Furthermore, it is conceivable to provide a plurality of surface regions along a circumferential direction in order to form the end face, each having a different surface normal and thus different effects with regard to the shaping of the fluid flow.

Another advantageous variant of the laser spark plug according to the exemplary embodiments and/or exemplary methods of the present invention, which effectively reduces the magnitude of the turbulence, is provided in that the arrangement or structure for influencing the fluid flow have at least one flow opening, which creates a fluid connection between a region of the ignition point and a region that is disposed radially on the outside of the arrangement or structure for influencing the fluid flow. These fluid connections provided according to the present invention allow fluids or gas mixtures present in the combustion chamber to be supplied to the ignition point in a controlled manner. In this way, turbulence on a relatively small scale is able to be realized locally, in particular, which further improves the ignition process at the ignition point. A corresponding flow channel may be assigned to the individual flow opening in order to realize the afore-described fluid connection.

Moreover, according to the exemplary embodiments and/or exemplary methods of the present invention, a plurality of flow openings may advantageously be provided at different levels, whose surface normals may lie approximately parallel to a longitudinal axis of the laser spark plug in order to be able to adjust defined flow conditions across a specifiable axial range and around the ignition point, in particular.

An especially precise control of the fluid flows routed through the flow openings or flow channels is possible if the flow openings or flow channels have a circular or rectangular cross-section. Moreover, the flow channels may advantageously be embodied as swirl channels.

According to another very advantageous variant of the exemplary embodiments and/or exemplary methods of the present invention, an improved supply of the ignition point with an ignitable fluid while simultaneously controlling the flow formation is provided in that at least one flow channel is disposed in such a way that its longitudinal axis runs through the ignition point.

According to the exemplary embodiments and/or exemplary methods of the present invention, a still further option for the selective influencing of a fluid flow in the region of the ignition point is advantageously provided in that at least one flow channel has a diameter that varies along its longitudinal axis. In an advantageous manner, the flow channels according to the present invention may furthermore have an advantageous nozzle shape for adjusting a corresponding flow behavior of the fluid in the combustion chamber.

One especially advantageous configuration of the laser spark plug according to the present invention is provided in that what may be a monolithically developed laser device having a laser-active solid body and a passive Q-switch is integrated into the laser spark plug, so that a local generation of high-energy laser pulses is possible in the laser spark plug according to the present invention.

In combination with the arrangement or structure for influencing the fluid flow in the region of the ignition point according to the present invention, this therefore realizes a very efficient and reliable laser ignition for an internal combustion engine.

The laser spark plug according to the present invention may in particular be used in stationary engines or in large gas engines, but its use in the automotive field is conceivable as well.

In an especially advantageous manner, the ignition point of the laser spark plug according to the present invention is selected as a function of the realization of the arrangement or structure according to the present invention for influencing the fluid flow. The location of the ignition point may be specified by the selection of a focal length of an employed focusing optic system, for example, which is integrated into the arrangement or structure for coupling the laser radiation, for instance.

Additional features, application options and advantages of the exemplary embodiments and/or exemplary methods of the present invention ensue from the following description of exemplary embodiments of the present invention, which are illustrated in the figures of the drawing. All of the described or illustrated features form the subject matter of the present invention, individually or in any combination, regardless of their combination in the patent claims or their antecedent reference, and also regardless of their formulation or illustration in the description or in the figures.

BRIEF DESCRIPTION OF THE DRAWINGS

FIG. 1 shows, in schematized manner, a partial cross-section of a first specific development of a laser spark plug according to the present invention.

FIG. 2 shows, in schematized manner, the placement of the laser spark plug according to FIG. 1 in a combustion chamber of an internal combustion engine.

DETAILED DESCRIPTION

Figure 3A:
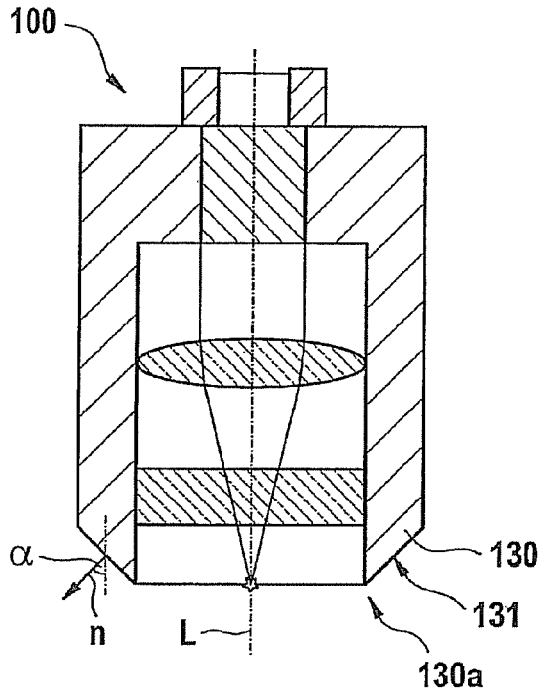
FIGS. 3*a*, 3*b*, and 3*c* show specific developments of a lateral surface of the structure for influencing a fluid flow according to the present invention.

FIG. 1 shows a first specific development of a laser spark plug 100 according to the present invention, in a partial cross-section. Laser spark plug 100 includes arrangement or structure 110 for coupling laser radiation 120 into an ignition point ZP in order to ignite an ignitable mixture in the region of ignition point ZP.

In this case, arrangement or structure 110 for coupling laser radiation 120 include focusing optics symbolized by a biconvex lens 111 for focusing laser radiation 120 on ignition point ZP. Furthermore, arrangement or structure 110 for coupling laser radiation 120 in this instance include a combustion chamber window 112 optically disposed downstream from focusing optics 111, which provides a spatial separation between an end region 100*a* on the side of the combustion chamber, and the further components of laser spark plug 100.

According to the present invention, laser spark plug 100 includes arrangement or structure 130 for influencing a fluid flow, which are disposed in its end region 100*a* on the side of the combustion chamber and are designed to influence a fluid flow in the region of ignition point ZP.

According to the present invention, this advantageously provides the possibility of protecting a flame core, which, for instance, occurs immediately following the laser ignition in ignition point ZP, from fluid flows having a level of turbulence that is critical with regard to a reliable further ignition.

According to one especially advantageous development of laser spark plug 100 of the present invention, arrangement or structure 130 for influencing the fluid flow are an integral part of laser spark plug 100. In the case at hand, arrangement or structure 130 are thus developed as essentially hollow-cylindrical or sleeve-type extension of the housing of laser spark plug 100 in the direction of the combustion chamber, beyond an end face plane 112*a* of combustion chamber window 112.

FIG. 2 shows laser spark plug 100 from FIG. 1 in a typical installation position in an internal combustion engine, of which only a combustion chamber 200 and a portion of the combustion chamber walls delimiting combustion chamber 200 are shown in FIG. 2 for reasons of clarity.

As can be gathered from FIG. 2, arrangement or structure 130 for influencing the fluid flow according to the present invention project into combustion chamber 200 and thus provide efficient protection of the flame core occurring at ignition point ZP against fluid flows having a level of turbulence that is excessive for a reliable ignition.

Furthermore, arrangement or structure 130 according to the present invention may also end with the cylinder head or even project into the cylinder head.

In the configuration of laser spark plug 100 according to the present invention and depicted in FIG. 2, the installation position of laser spark plug 100 relative to combustion chamber 200 has been selected such that an end face 112*a* of combustion chamber window 112 (FIG. 1) lies in approximately the same plane as a combustion chamber wall that delimits combustion chamber 200 toward the top in FIG. 2.

According to one development, focusing optics 111 are advantageously developed in such a way that they focus laser radiation 120 on an ignition point ZP, which roughly lies in a plane that is defined by the end faces of arrangement or structure 130 for influencing the fluid flow, which end faces lie on the side of the combustion chamber.

In one especially advantageous development of laser spark plug 100 according to the present invention, a laser device 105 may have a monolithic form, cf. FIG. 1, which has a laser-active solid body and a passive Q-switch, is directly integrated into laser spark plug 100. In this configuration of the present invention, relatively energy-rich laser pulses 120 are able to be generated locally, directly in laser spark plug 100.

The pumping light required for generating laser pulses 120 may advantageously be supplied to laser device 105 via a pumping light source disposed at a distance from laser spark plug 100 and not shown, and via a corresponding light guide device, which optically connects the pumping light source with laser spark plug 100.

Although the configuration of laser spark plug 100 according to the present invention as shown in FIGS. 1, 2, having the essentially sleeve-type arrangement or structure 130 for influencing the fluid flow, constitutes an exemplary variant of the present invention, it is furthermore possible that arrangement or structure 130 for influencing the fluid flow according to the present invention also have a geometry that differs from the hollow-cylindrical base form, or that they are not disposed concentrically with respect to longitudinal axis L (FIG. 1) of laser spark plug 100, as illustrated.

Furthermore, according to the present invention, it is also possible, in particular, to provide essentially sleeve-shaped arrangement or structure 130 with notches (not shown), so that a plurality of openings may result along a circumferential direction of laser spark plug 100, which allow for a fluid exchange between the region of ignition point ZP and a region that is disposed radially outside of the housing of laser spark plug 100.

FIG. 3*a* shows another specific embodiment of laser spark plug 100 according to the present invention, in which end face 131 of arrangement or structure 130 for influencing the fluid flow according to the present invention is at least sectionally beveled in its terminal region 130*a* on the side of the combustion chamber, so that a surface normal n forms an angle with longitudinal axis L of laser spark plug 100 that differs from 0°. In this configuration, an efficient rerouting of turbulent flows out of combustion chamber 200 (FIG. 2) comes about, so that, once again, a flame core produced in the region of ignition point ZP is effectively protected from an excessive level of turbulence.

Figure 3B:
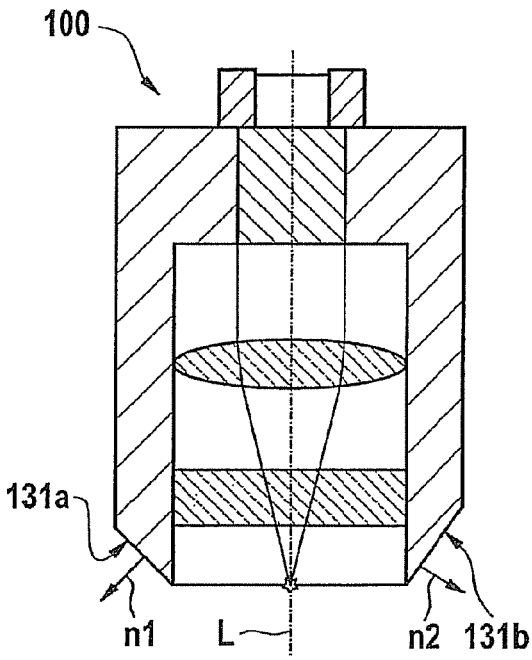

FIG. 3*b* illustrates an additional variant of the present invention, in which arrangement or structure 130 for influencing the fluid flow according to the present invention likewise have surface areas 131*a*, 131*b* having beveled end faces. In contrast to the variant of the invention shown in FIG. 3*a*, laser spark plug 100 according to FIG. 3*b* has in the arrangement or structure 130 for influencing the fluid flow according to the present invention surface areas 131*a*, 131*b* that have a different type of beveling, through which, in particular, also an unsymmetrical flow deflection in the terminal region of laser spark plug 100 on the side of the combustion chamber is able to be achieved in an advantageous manner.

Accordingly, surface normals n1, n2 of differently beveled surface areas 131*a*, 131*b* form different angles with longitudinal axis L of laser spark plug 100 in each case.

Figure 3C:
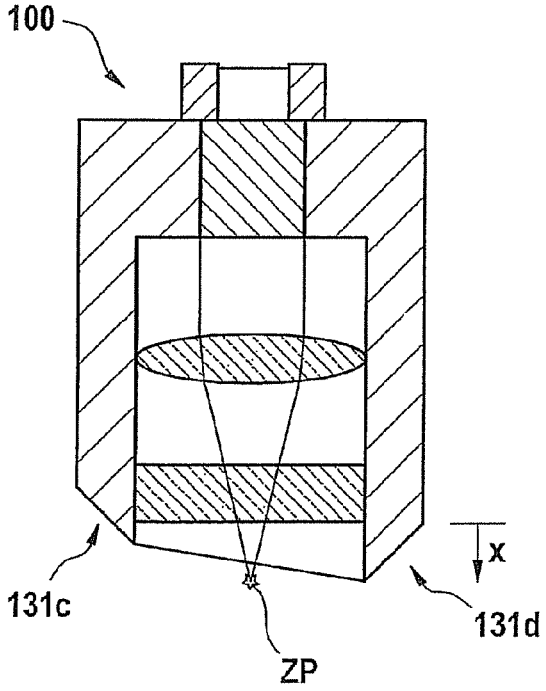

FIG. 3*c* shows an additional variant of laser spark plug 100 according to the present invention, in which different regions 131*c*, 131*d* along spatial coordinate x, shown in FIG. 3*c* by way of example, extend to different extents in a direction on the side of the combustion chamber, i.e., in a downward direction in FIG. 3*c*.

This once again advantageously achieves an unsymmetrical flow-protecting effect for ignition point ZP, such that a fluid flow traveling from the right toward ignition point ZP in FIG. 3*c* is deflected more strongly from ignition point ZP than a fluid flow traveling from the left toward ignition point ZP in FIG. 3*c*. This dissymmetry according to the present invention with respect to arrangement or structure 130 for influencing the fluid flow is able to be combined in an especially advantageous manner with an arrangement or structure, integrated in a piston (not shown), for routing a fluid flow into combustion chamber 200 (FIG. 2) of the internal combustion engine.

Figure 4A:
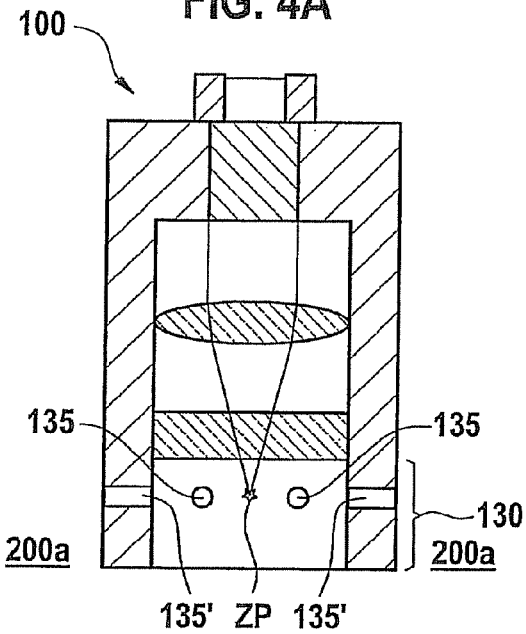
FIGS. 4*a*, 4*b*, 4*c*, 4*d*, 4*e*, 4*f*, 4*g*, and 4*h* show specific developments of a lateral surface of the structure for influencing a fluid flow according to the present invention.

FIG. 4*a* shows an additional advantageous specific embodiment of laser spark plug 100 according to the present invention, in which arrangement or structure 130 for influencing the fluid flow have a plurality of flow openings 135, which in combination with corresponding flow channels 135', create a fluid connection between a region of ignition point ZP and a region 200*a* disposed radially outside of arrangement or structure 130 for influencing the fluid flow.

Flow openings 135 according to the present invention, and associated flow channels 135' advantageously make it possible to reduce the magnitude of the turbulence of fluid flows traveling radially from the outside toward the combustion-chamber-side end of laser spark plug 100. Thus, in an especially advantageous manner, the level of turbulence in ignition point ZP is able to be kept below a level that is critical with regard to a reliable ignition process.

The number, form, orientation and size of flow openings 135 or flow channels 135' is adapted to the particular flow conditions of the individual internal combustion engine, or may be optimized for it, and may use numerical flow simulations.

Figure 4B:
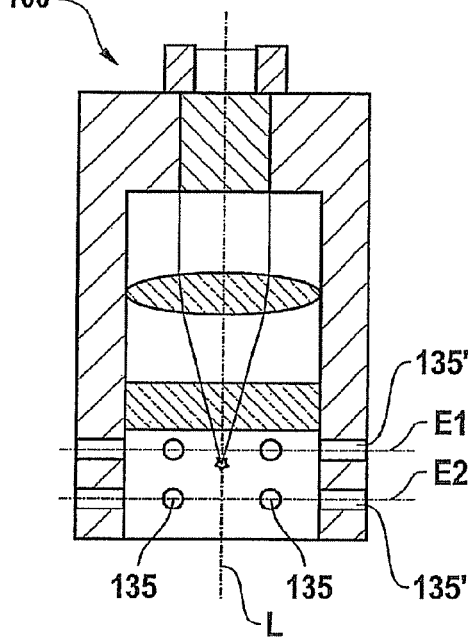

FIG. 4*b* shows an additional specific embodiment of laser spark plug 100 according to the present invention, in which a plurality of flow openings 135 and corresponding flow channels 135' are provided in different planes E1, E2, whose surface normals may lie approximately parallel to longitudinal axis L of laser spark plug 100.

Figure 4C:
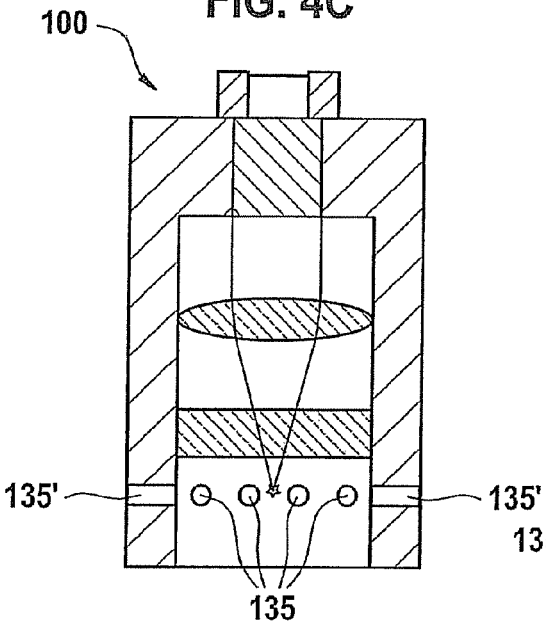
Figure 4D:
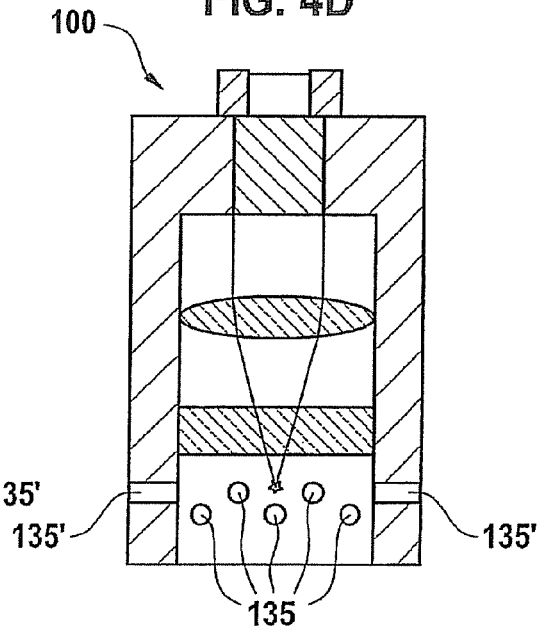

FIGS. 4*c*, 4*d* show additional advantageous specific embodiments of laser spark plug 100 according to the present invention, in which a plurality of flow openings 135 and flow channels 135' is provided, in different configurations in each case.

Figure 4E:
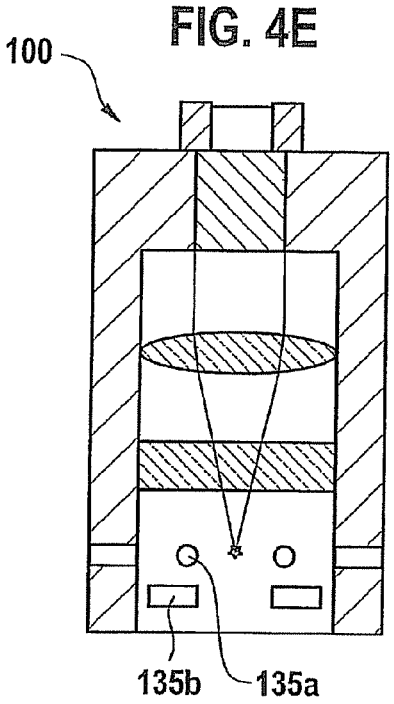

FIG. 4*e* shows a further specific embodiment of laser spark plug 100 according to the present invention, in which a first group of flow openings 135*a* has a circular cross-section as in the previously described specific embodiments, while a second group of flow openings 135*b* has a rectangular cross-section.

Figure 4F:
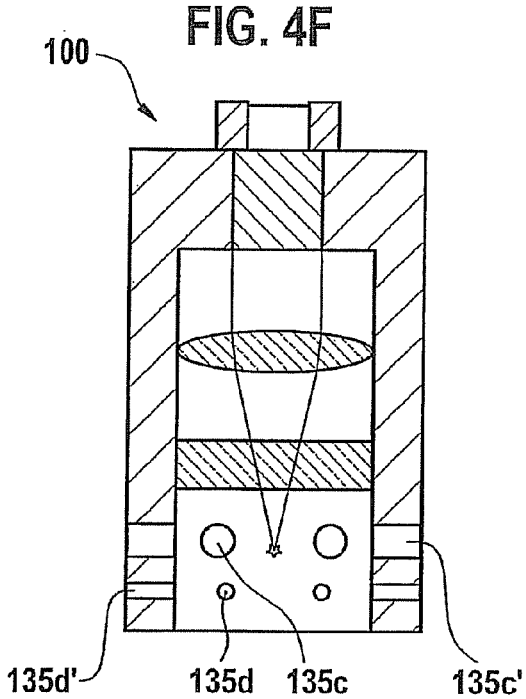

FIG. 4*f* shows an additional specific embodiment of laser spark plug 100 according to the present invention, in which flow openings 135*c*, 135*d* are provided, both of which have a circular form, but different diameters.

Arrangement or structure 130 for influencing the fluid flow of laser spark plug 100 according to the present invention and shown in FIG. 4*f*, furthermore also have differently implemented flow channels 135*c*', 135*d*', whose diameter is adapted by way of example to flow openings 135*c*, 135*d*.

Figure 4G:
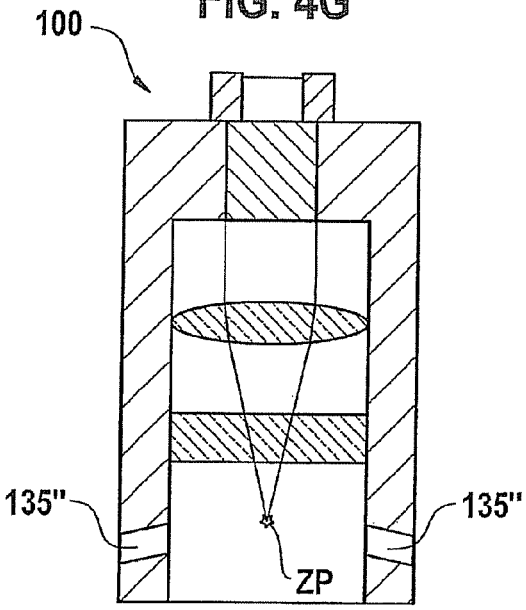

In an additional variant of laser spark plug 100 according to the present invention and illustrated in FIG. 4*g*, flow channels 135" are disposed in such a way that their longitudinal axles run through ignition point ZP in each case.

Figure 4H:
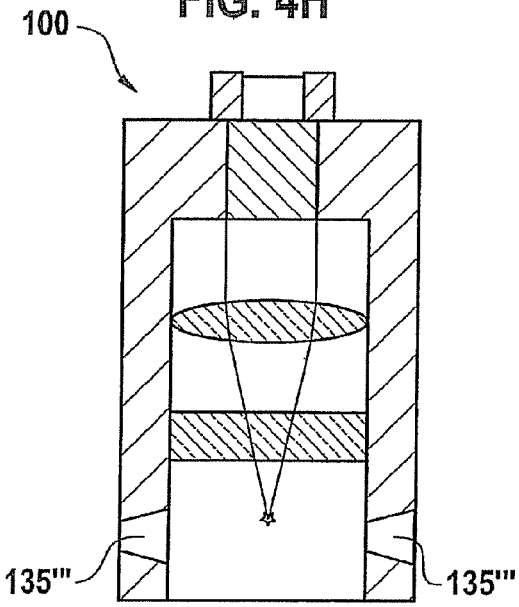

In the additional specific development of laser spark plug 100 according to the present invention shown in FIG. 4*h*, flow channels 135" have a diameter that varies along the longitudinal axis of flow channel 135", so that a nozzle effect is produced with regard to the fluid flow passing through it.

FIGS. 5*a*-5*f* illustrate differently developed lateral surfaces of essentially sleeve-shaped arrangement or structure 130 for influencing the fluid flow.

Figure 5A:
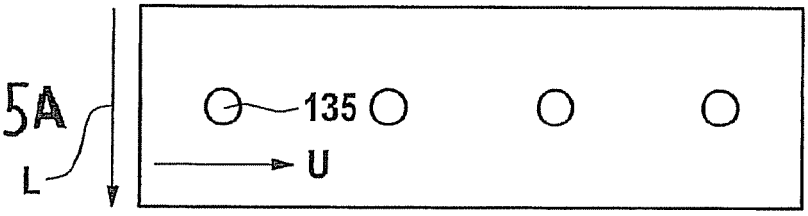
FIG. 5*a*, 5*b*, 5*c*, 5*d*, 5*e*, and 5*f* show specific developments of a lateral surface of the structure for influencing a fluid flow according to the present invention.

FIG. 5*a* shows a first variant of a lateral surface for arrangement or structure 130 for influencing the fluid flow according to the present invention, which has a total of four flow openings 135. As can be gathered from FIG. 5*a*, flow openings 135 are disposed along a circumferential direction U and, in relation to longitudinal axis L of laser spark plug 100 (FIG. 1), thus are located in essentially the same plane.

Figure 5B:
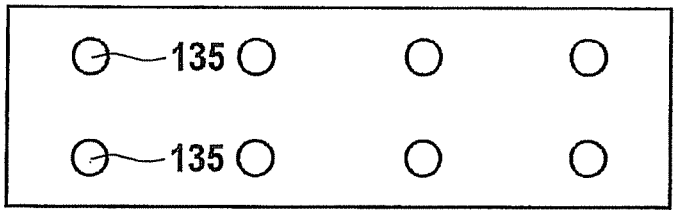
Figure 5C:
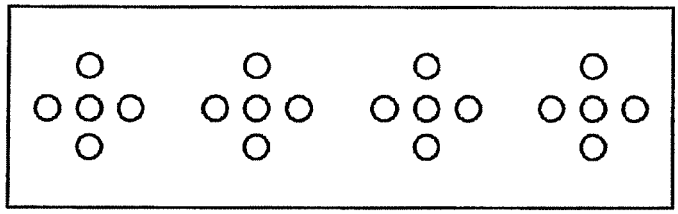
Figure 5D:
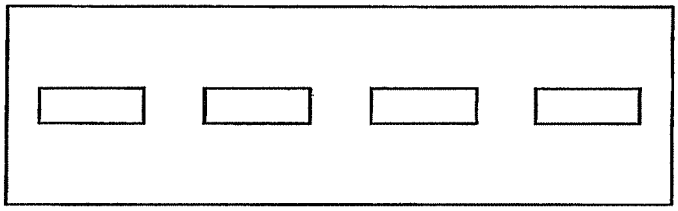
Figure 5E:
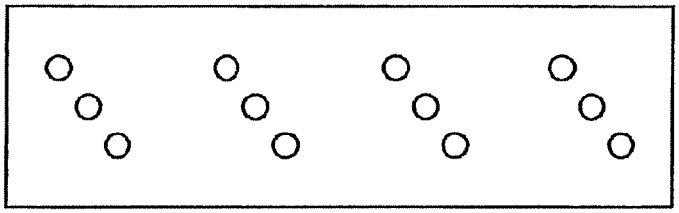

FIG. 5*b* shows another specific embodiment of the lateral surface of arrangement or structure 130 for influencing a fluid flow according to the present invention, where a configuration of flow openings 135 in two rows is provided.

Additional possible combinations of flow openings in the lateral surface of arrangement or structure 130 for influencing the fluid flow according to the present invention can be gathered from FIGS. 5*c*-5*f*.

Figure 5F:
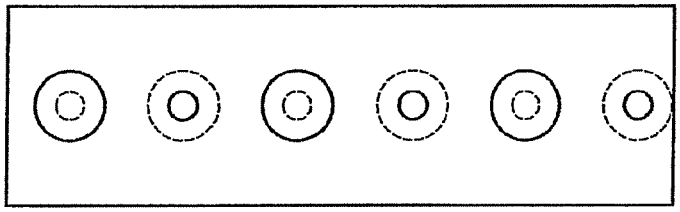

The configuration shown in FIG. 5*f* has specially shaped flow channels, which essentially have a frustoconical form. According to FIG. 5*f*, these flow channels are disposed in alternation along circumferential direction U via their greater or smaller frustum of a cone diameter in the region of the drawing plane of FIG. 5*f*.

In general, the afore-described features of arrangement or structure 130 for influencing the fluid flow according to the present invention may also be used in combinations other than the explicitly described combinations.

Laser spark plug 100 according to the present invention allows a reliable laser ignition even at relatively low pulse energies. A plurality of laser pulses 120 taking place in short succession may be used for an ignition process, which because of the influencing of the fluid flow according to the present invention in the region of ignition point ZP, are advantageously all able to be deposited in the same flame core.

What is claimed is:

1. A laser spark plug for an internal combustion engine, comprising:

a coupling arrangement to couple and focus laser radiation in or on an ignition point; and an influencing arrangement to influence a fluid flow disposed in an end region of the laser spark plug on the side of the combustion chamber, which represent an essentially sleeve-shaped extension of the laser spark plug in the direction of the combustion chamber;

wherein the influencing arrangement is configured to influence the fluid flow in the region of the ignition point, wherein the influencing arrangement has in its end region on the combustion chamber side an at least sectionally beveled end face, whose surface normal forms an angle with a longitudinal axis of the laser spark plug that differs from 0°, and wherein the end face has along a circumferential direction at least two different surface areas, whose surface normals in each case form a different angle with the longitudinal axis of the laser spark plug.

2. The laser spark plug of claim 1, wherein the influencing arrangement is an integral part of the laser spark plug.

3. The laser spark plug of claim 1, wherein the influencing arrangement has an essentially hollow-cylindrical base form and is disposed concentrically with respect to a longitudinal axis of the laser spark plug.

4. The laser spark plug of claim 1, wherein the influencing arrangement has at least one flow opening, which provides a fluid connection between a region of the ignition point and a region that is disposed radially on the outside of the influencing arrangement.

5. The laser spark plug of claim 4, wherein at least one flow opening has a flow channel that extends essentially radially to a longitudinal axis of the laser spark plug.

6. The laser spark plug of claim 4, wherein a plurality of flow openings is provided in different planes, whose surface normals are approximately parallel to a longitudinal axis of the laser spark plug.

7. The laser spark plug of claim 4, wherein the flow openings or flow channels have a circular cross-section or a rectangular cross-section.

8. The laser spark plug of claim 5, wherein at least one flow channel is configured as a swirl channel.

9. The laser spark plug of claim 5, wherein at least one flow channel is disposed so that its longitudinal axis runs through the ignition point.

10. The laser spark plug of claim 5, wherein at least one flow channel has a diameter that changes along its longitudinal axis.

11. The laser spark plug of claim 5, wherein there is a plurality of flow channels having different sizes or cross-sectional surfaces.

12. The laser spark plug of claim 1, wherein there is a monolithically configured laser device having a laser-active solid body and a passive Q-switch.

13. A method for igniting a fluid in an internal combustion engine, the method comprising:

providing a plurality of laser pulses so that they occur in brief succession and using them for an ignition process; and depositing the laser pulses in the same flame core by influencing a fluid flow in a region of an ignition point;

wherein a laser spark plug has a coupling arrangement for focusing laser radiation to or on the ignition point and having an influencing arrangement to perform the influencing of the fluid flow, which are disposed in an end region of the laser spark plug on the side of the combustion chamber, and which are configured to influence the fluid flow in the region of the ignition point by the laser spark plug, wherein the influencing arrangement has in its end region on the combustion chamber side an at least sectionally beveled end face, whose surface normal forms an angle with a longitudinal axis of the laser spark plug that differs from 0°, and wherein the end face has along a circumferential direction at least two different surface areas, whose surface normals in each case form a different angle with the longitudinal axis of the laser spark plug.

14. A laser spark plug for an internal combustion engine, comprising:

a coupling arrangement to couple and focus laser radiation in or on an ignition point; and an influencing arrangement to influence a fluid flow disposed in an end region of the laser spark plug on the side of the combustion chamber, which represent an essentially sleeve-shaped extension of the laser spark plug in the direction of the combustion chamber;

wherein the influencing arrangement is configured to influence the fluid flow in the region of the ignition point, and wherein the influencing arrangement is completely open on the side of the combustion chamber.

* * * * *